United States Patent [19]

Chessler

[11] 4,282,992

[45] Aug. 11, 1981

[54] CLOSURE DEVICE FOR A DISPENSING CONTAINER

[76] Inventor: Bernard Chessler, 244 W. 74 St., New York, N.Y. 10023

[21] Appl. No.: 99,039

[22] Filed: Nov. 30, 1979

[51] Int. Cl.[3] ..... B67D 3/00

[52] U.S. Cl. ..... 222/538

[58] Field of Search ..... 222/507, 548, 553, 538, 222/182, 555

[56] References Cited

U.S. PATENT DOCUMENTS

| | | | |
|---|---|---|---|
| 1,170,181 | 2/1916 | O'Kane . | |
| 1,685,147 | 9/1928 | Case . | |
| 1,789,955 | 1/1931 | Brownson . | |
| 2,281,620 | 5/1942 | Rueger . | |
| 2,319,252 | 5/1943 | Monnet . | |
| 3,542,260 | 11/1970 | Souza | 222/548 |

*Primary Examiner*—Stanley H. Tollberg

*Attorney, Agent, or Firm*—Hubbell, Cohen, Stiefel & Gross

[57] ABSTRACT

A container for pastes, gels, creams or the like comprising a flexible tubular body having a neck portion enclosing an outflow passage, a closure connected to the tubular body and extending across the outflow passage, a spout extending outwardly from the closure and a cover for the spout. The orientation of the cover and the design of the spout facilitates the clean and easy removal of the contents of the container.

5 Claims, 12 Drawing Figures

CLOSURE DEVICE FOR A DISPENSING CONTAINER

BACKGROUND OF THE INVENTION

1. Field of the Invention

This invention pertains to containers for pastes, gels, creams or the like and more particularly to flexible containers of the type mentioned having closures which are permanently attached to the container.

2. Statement of the Prior Art

Containers for pasty substances such as, for example, toothpaste, with permanently attached closure members are, of course, well known in the art. For example, U.S. Pat. No. 2,319,252 discloses and claims a closure for a compressible tube containing a pasty substance. The closure member, which fits over the container neck and is permanently attached thereto, has a spout-type opening through which the contents of the container are dispensed. The closure member is covered by a cap which is permanently attached to the container. The cover is provided with an opening which is preferably slightly larger than the spout-type opening in the closure member and which is adapted to be situated directly over the spout-type opening when the cover is rotated to the appropriate position. In order to remove the contents of the container, the user rotates the cover until its opening is in alignment with the spout.

Other similar closures for compressible tubes containing pasty substances and the like are disclosed in U.S. Pat. Nos. 1,789,955; 1,685,147; 1,170,181 and 2,281,620.

These prior art types of closure devices, however, have a number of disadvantages. First, when the user rotates the cover to a closed position pasty residue remaining above the spout-type opening will be cut away by the action of the revolving cap and will become lodged on the top surface of the cap. This occurs because the spout-type opening does not have a sharp outer edge to facilitate the clean removal of the paste or the like. Such a condition is undesirable, since once the residue becomes exposed to the air it will decay and thus create an unsanitary condition. Second, when the cap is rotated to a closed position the pasty residue can accumulate and harden between the spout-type opening and the bottom surface of the cover, thereby inhibiting or even preventing rotation of the cap. Third, the residue remaining on or near the spout-type opening will decay when exposed to the air and create an unsanitary condition. Thus, subsequent use of the container becomes undesirable since paste or the like will be exposed to the decayed material when it is dispensed. The present invention solves these and other problems not specifically discussed herein.

SUMMARY OF THE INVENTION

The invention is directed to an improved dispensing container for pastes, gels, creams and the like which includes a cover which is permanently attached to the container and rotatably positioned thereon.

The components of the dispensing container include a flexible tubular body having a neck portion enclosing an outflow passage, a closure connected to the tubular body and extending across the outflow passage, a spout extending outwardly from the closure and a cover for the spout. The closure has a circular disc shaped top portion and a skirt extending downwardly from the periphery of the top portion. The closure is attached to the neck portion of the tubular body along the downwardly extending skirt. The cover for the spout is permanently attached to the container and rotatably mounted thereon.

When it is desired to extract a portion of the contents of the container, the cover is rotated out of alignment with the spout and a squeezing force is applied to the flexible tubular body to force a portion of the container contents out of the tube. When the container is not in use, the cover is rotated into alignment with the spout, thereby forming together with the closure a sealingly enclosed space surrounding the spout. When in this position, the outer edge of the spout abuts the interior surface of one of the wall members of the cover. This arrangement thus prevents the accidental discharge of the container contents into the space surrounding the spout. A sharp outer edge on the spout will facilitate the clean removal of material from the container and thereby prevent the accumulation of residue on the spout.

In one embodiment of the invention, the spout projects outwardly from the top surface of the closure, while the cover rides on the top surface of the closure as it is rotated in and out of alignment with the spout. In another embodiment of the invention, the spout is located within a cutout section formed in the closure, while the cover rides in a continuous groove which circumscribes the cutout section. In this embodiment, the cover is substantially flush with the top surface of the closure when it is rotated into alignment with the spout and disappears within the continuous groove in the closure when it is rotated out of alignment with the spout.

The design and operation of the dispensing container facilitates the clean and easy removal of the contents of the container.

DETAILED DESCRIPTION OF THE PREFERRED EMBODIMENT

Figure 1:
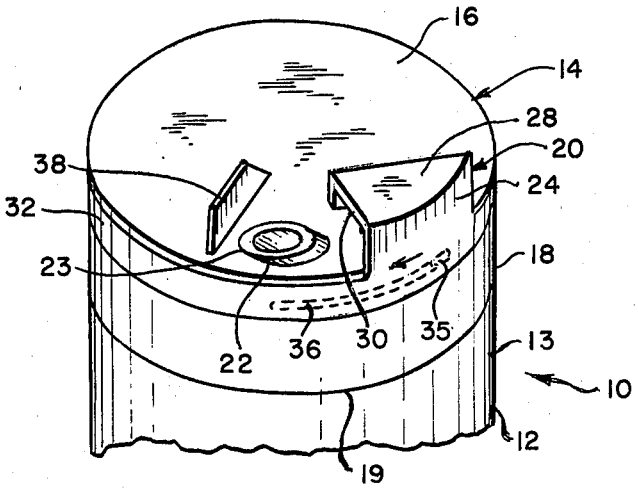
FIG. 1 is a perspective view of the upper portion of the dispensing container from the front of the dispensing container, illustrating the cover in an open position.

Referring now to FIGS. 1–3*b* in detail, the preferred dispensing container is generally designated by the reference numeral 10. As illustrated, the principal structural components of the container 10 are a tubular body 12, a closure 14 having a top portion 16 in the shape of a circular disc and a skirt 18 extending downwardly from the periphery of top portion 16 and a cover 20 rotatably positioned on skirt 18 of the closure. While container 10 is preferably a squeeze tube container such as a toothpaste tube, it may be a piston-cylinder type container whereby material within the container is dispensed by the action of a hand-propelled piston rather than a squeezing force. A dispenser for caulking material would be an example of such a container.

Tubular body 12 may be constructed of any type of flexible or collapsible material, although it is preferred that it be constructed of a metal such as aluminum, or a laminate of various combinations of paper foil and plastics or a plastic of single wall construction. Presently, thermoplastics in the polyolefin family such as polyethylene are preferred, although other suitable materials such as polyamides, polyesters, vinyl polymers and copolymers, polymers of vinylidene chloride, polystyrene and polypropylene and its copolymers can be used.

Figure 3B:
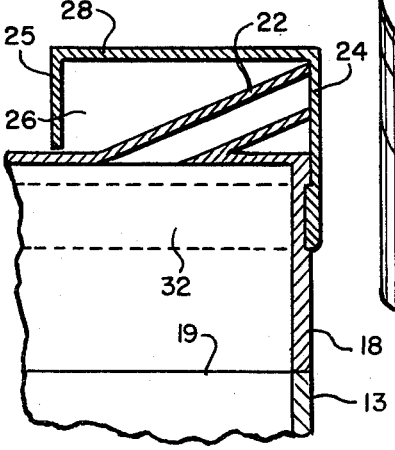
FIG. 3*b* is an enlarged fragmentary sectional view taken along line 3*b*—3*b* in FIG. 2.
Figure 3A:
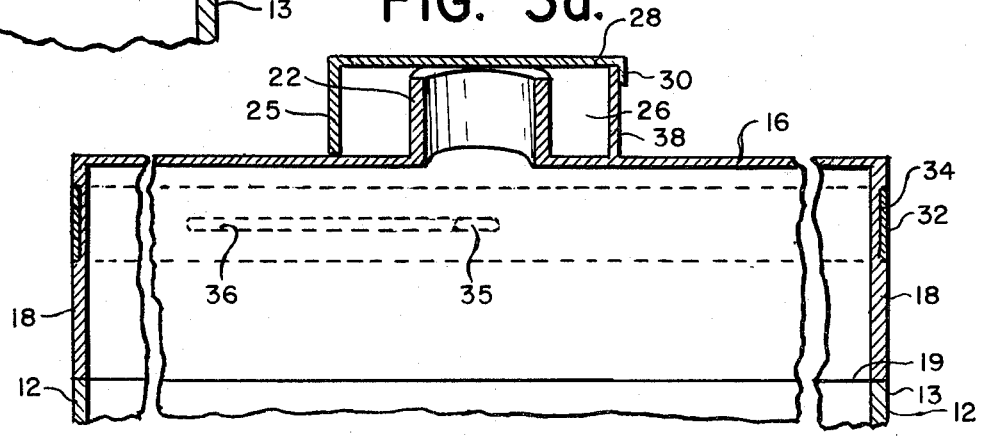
FIG. 3*a* is an enlarged fragmentary sectional view taken along line 3*a*—3*a* in FIG. 2.

While not shown, tubular body 12 is sealed or closed at one end, for example, by the use of heat and pressure, while the opposite end of the container has a neck portion 13 enclosing the outflow passage. As is best illustrated in FIG. 3*a*, closure 14 is sealingly connected to neck portion 13 of tubular body 12 along the outer rim 19 of skirt 18. The term sealingly connected as used throughout the specification and claims is defined herein to mean a sealing arrangement which substantially prevents the passage of air, moisture and solids. Preferably an injection molding technique is employed to from the closure and fuse the same to the tubular body. It is, however, contemplated that compression molding may be used, and, alternatively, the closure 14 may be separately molded and heat sealed to the tubular body. While closure 14 can be constructed of any suitable material, it is preferably constructed of a rigid material. Such materials include metals, plastics and rubberlike materials including both natural and synthetic rubber compositions.

Figure 2:
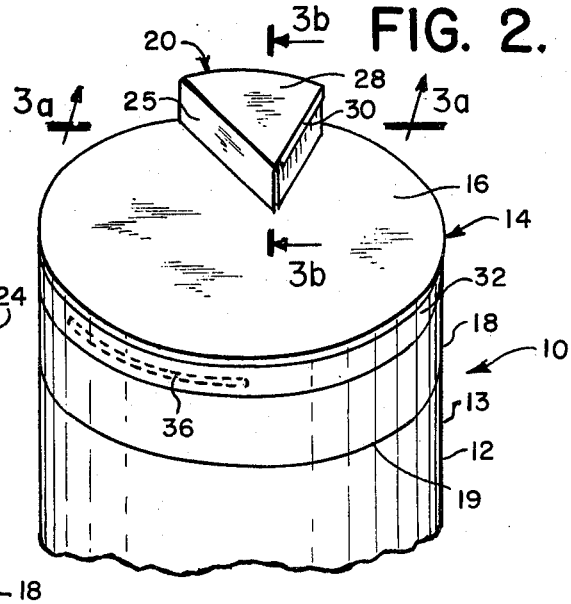
FIG. 2 is a perspective view of the dispensing container looking from the rear, illustrating the cover in a closed position.

According to the invention, material within the container 10, is dispensed through spout 22 which is connected to and extends outwardly from top portion 16 of closure 14. Spout 22 can be either manufactured as an integral part of the closure or independently thereof and later attached thereto. While the spout can be oriented in any manner such as normal to top portion 16, it is preferably oriented at a 45° angle with respect to the top portion 16. As best illustrated in FIG. 3*b*, when spout 22 is oriented in the preferred manner, its outer edge 23 abuts the interior portion of an arcuate wall member 24 when cover 20 is in the closed position. It will be apparent that such an arrangement will prevent the accidental discharge of the container contents into an enclosed space 26 surrounding spout 22 when cover 20 is in the closed position (FIGS. 2, 3*a* and 3*b*). Additionally, spout 22 preferably has a sharp outer edge 23 to facilitate the clean removal of the contents from the container and to prevent the acculation of residue on outer edge 23.

The cover for spout 22, indicated generally be reference numeral 20, preferably comprises an outer cover portion 28 vertical wall members 24 and 25 and an annular flange 32. If desired, inwardly projecting flexible flap 30 may form a part of cover portion 28 in order to prevent accidental opening of the container 10 when not is use, as will be explained hereinafter. Like closure 14 cover 20 is preferably constructed of a rigid material such as metal, plastic or a rubber-like material including both natural and synthetic rubber compositions. Cover 20 is preferably rotatably attached to skirt 18 of closure 16 but is not longitudinally movable relative thereto.

While numerous arrangements may be used to rotably position cover 20 on container 10, it is presently preferred to employ the arrangement shown in the drawings. Thus, as shown in FIGS. 3*a* and 3*b*, annular flange 32 is positioned within annular recess 34 located on the exterior surface of skirt 18, so that it is flush with the exterior surface of the skirt, thereby retaining cover 20 from longitudinal movement but allowing its revolution. Additionally, annular flange 32 has an internal rib or bead 35 which interfits within an external groove 36 located within and extending partially around annular recess 34. It will be apparent that even though rotation of cover 20 is allowed, the degree of rotation will be limited by the distance bead 35 can travel in groove 36. Preferably, cover 20 is only permitted to rotate between the closed position as shown in FIG. 2 and the open position as illustrated in FIG. 1. Thus, together, bead 35 and groove 36 act as a stop to limit the degree of rotation of cover 20.

As shown in FIG. 1, when it is desired to extract a portion of the contents of the container, cover 20 is rotated so as to reveal spout 22. The container is then slightly tilted and a portion of the contents is forced out by the application of a squeezing force to tubular body 12. The container can thereafter be closed by rotatably positioning cover 20 in alignment with spout 22. As shown in FIG. 2 when the cover is rotated to a closed position, vertical wall members 24 and 25 form a substantially continuous wall with wall member 38 which extends outwardly from closure 14. Like spout 22, wall member 38 can either be manufactured as an integral part of closure 14 or independently thereof and later attached thereto. Preferably, wall member 25 forms a sealing engagement with top portion 16. Such a sealing engagement substantially prevents the passage of air, moisture, and solids. Thus, wall members 24, 25 and 38, upper cover portion 28, together with top portion 16, define previously mentioned enclosed space 26 surrounding spout 22. Moreover, as shown and preferred in FIGS. 2 and 3*a*, flap 30 overlaps wall member 38 when the cover is in the closed position, thereby preventing the accidental rotation of cover 20, and thus preventing the accidental opening of container 10 when not is use. Since the spout 22 is sealingly enclosed within space 26 when the cover is in the closed position, dirt, dust, bacteria and other foreign substances in the air cannot come into contact with the spout when the dispensing apparatus is not is use.

Another embodiment of the invention is illustrated in FIGS. 1–11 and will be described with reference to the drawings. The preferred dispensing container in the embodiment is designated generally by reference numeral 50. As illustrated, the principal structural components of the container 50 are a tubular body 52, a closure generally designated 54 having a top portion 56 in the shape of a circular disc and a skirt 58 extending downwardly from the periphery of top portion 56 and a cover unit generally designated 90.

Figure 9:
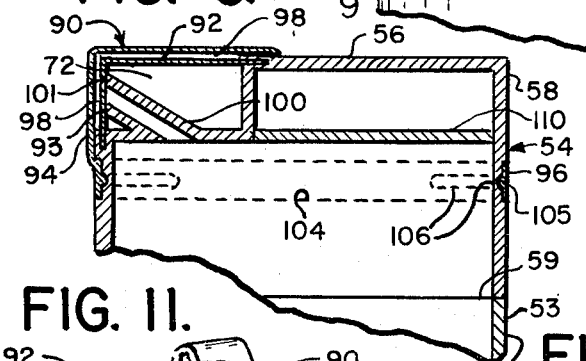
FIG. 9 is a fragmentary sectional view, similar to FIG. 6, taken along line 9—9 in FIG. 7.
Figure 6:
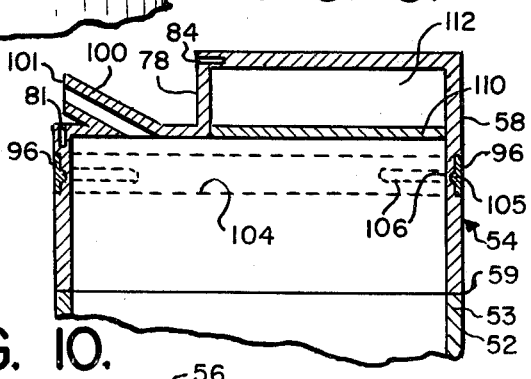
FIG. 6 is another fragmentary sectional view taken along line 6—6 in FIG. 4, illustrating the directing disc in a plane parallel to the top surface of the closure.

As previously described in connection with the embodiment illustrated in FIGS. 1–3*b*, the tubular body 52 may be constructed of any type of flexible or collapsible material and is sealed at one end, for example, by the use of heat and pressure while the opposite end of the container has a neck portion 53 enclosing an outflow passage. As is best illustrated in FIGS. 6 and 9, closure 54 is sealingly connected to neck portion 53 of tubular body 52 along the outer rim 59 of skirt 58. Preferably an injection molding technique, such as referred to with respect to the embodiment of FIGS. 1–3*b*, is employed to form the closure and fuse the same to the tubular body; however, compression molding may be used, and, alternatively, the closure may be separately molded and be heat sealed to the tubular body. Again, while closure 54 can be constructed of any suitable material, it is preferably constructed of a rigid material. Such materials include metals, plastics and rubber-like materials including both natural and synthetic rubber compositions.

As is readily apparent from the drawings, the primary difference between the embodiment of FIGS. 1–3*b* and the embodiment of FIGS. 4–11 resides in the closures 14 and 54, respectively.

Figure 4:
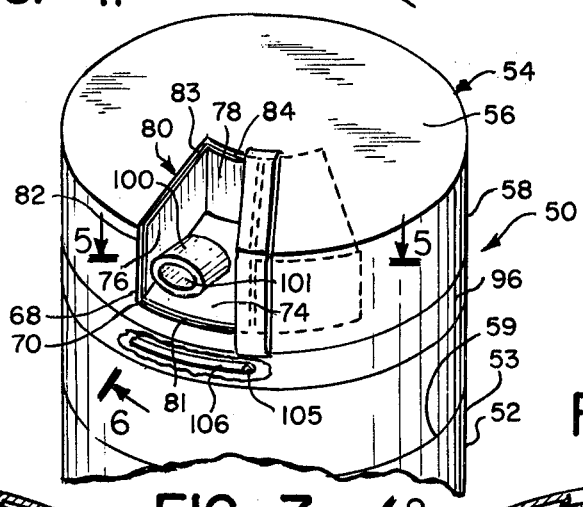
FIG. 4 is a perspective view, similar to FIG. 1, of the upper portion of another embodiment of the dispensing container looking from the front, and illustrating the cover in an open position.
Figure 5:
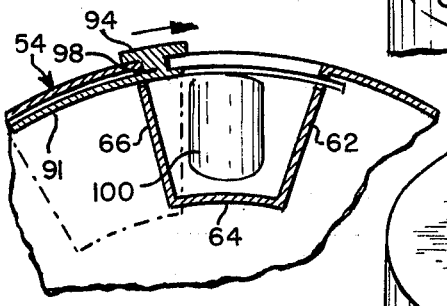
FIG. 5 is an enlarged fragmentary section view taken along line 5—5 in FIG. 4.
Figure 7:
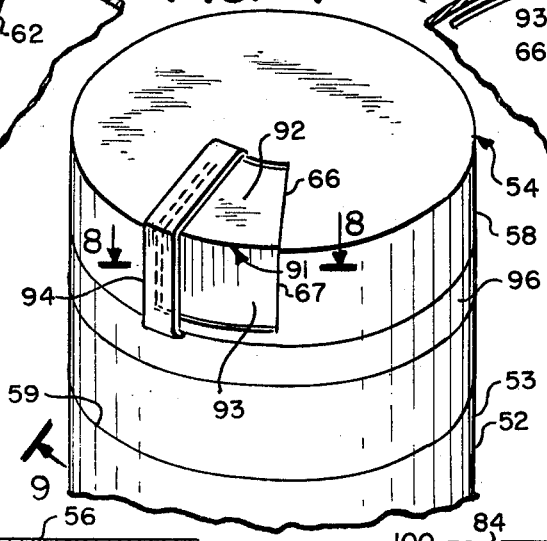
FIG. 7 is a perspective view similar to FIG. 4 of the upper portion of the embodiment shown in FIG. 4 and illustrating the cover in a closed position.

Thus, unlike closure 14 illustrated in the embodiment shown in FIGS. 1–3*b*, closure 54 has two cutout sections defining a chamber in which spout 100 is housed. As best shown in FIGS. 4, 5 and 7, edges 62, 64 and 66 define a first cutout section in the top portion 56 of closure 54 and edges 67, 68 and 70 define a second cutout section in the skirt 58 of closure 54. Together, the first and second cutout sections define a chamber 72 having a base portion 74, a first side wall 76, a second side wall (not shown) and an arcuate rear wall 78. A continuous groove generally designated 80 extends around the edges of the first and second cutout sections, thereby providing a recess in which a cap 91 of cover unit 90 rides as will be described in greater detail hereinafter.

Figure 8:
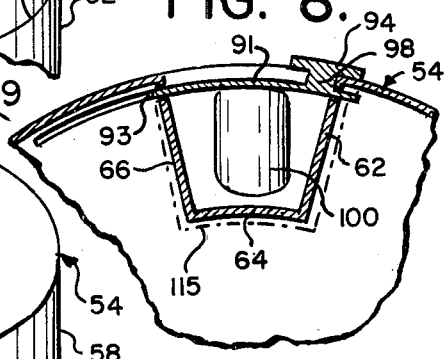
FIG. 8 is an enlarged fragmentary sectional view taken along line 8—8 in FIG. 7.

According to the invention, material within container 50 is dispensed through spout 100 which is connected to base portion 74 of closure 54 and projects outwardly therefrom. Preferably, spout 100 is oriented at a 45° angle with respect to base portion 74, although other angles of projection such as normal to the base portion may be used. As shown in FIG. 9, when spout 100 is oriented in the preferred manner, its outer edge 101 abuts the interior surface of arcuate wall member 93 of cap 91. It will be apparent that such an arrangement will prevent the accidental discharge of the container contents into space 72 when cover 90 is in the closed position (FIGS. 7, 8 and 9). Additionally, spout 100 preferably has a sharp outer edge 101 to facilitate the clean removal of the contents from the container and to prevent the acculation of residue on the outer edge 101.

Figure 11:
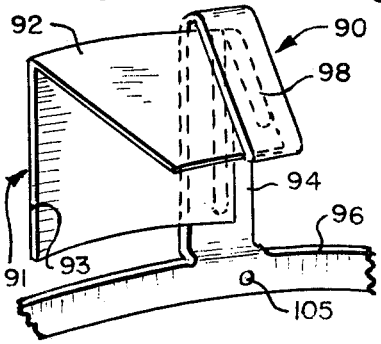
FIG. 11 is an enlarged fragmentary perspective view of a portion of the cover as illustrated in FIG. 7.

As best shown in FIG. 11, the preferred cover unit generally designated 90 for spout 100 comprises a cap 91, having an outer cap portion 92 and a arcuate wall member 93, a support member 94 and an annular flange 96. Support member 94 which is connected to annular flange 96 is attached to the outer cap portion 92 and wall member 93 along rib 98. It will be apparent that since rib 98 is narrower in width than support member 94, there will be a space between cap 91 and support member 94 on either side of rib 98. Rib 98 may be shorter in length than illustrated in FIG. 9, but it can never be longer. Thus, rib 98 can never extend beyond the plane formed by base 74 or beyond the plane formed by rear wall 78. While it is presently preferred to integrally form cover unit 90, it can be manufactured by, first, individually forming cap 91, support member 94 and annular flange 96 and thereafter securing the members together, for example, with an adhesive.

Figure 10:
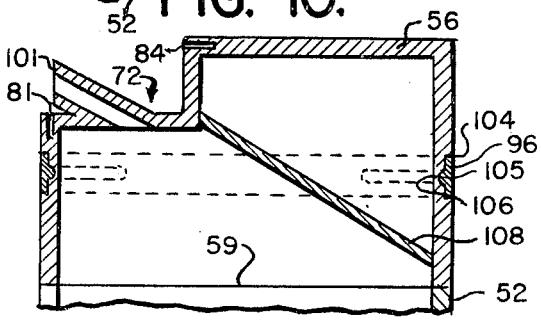
FIG. 10 is a fragmentary sectional view, similar to FIG. 6, taken along line 6—6 in FIG. 4 illustrating the directing disc oriented at an angle to the top surface of the closure.

Like cover 20, illustrated in FIGS. 1–3*b*, cover 90 is permanently attached to the closure 54 and rotatably positioned thereon. While numerous arrangements may be used to rotatably position cover unit 90 on the container 50, it is presently preferred to employ the type of arrangement described in connection with the embodiment illustrated in FIGS. 1–3*b*. Thus, as shown in FIGS. 4 and 10, annular flange 96 is positioned within annular recess 104 located on the exterior surface of skirt 58 so that it is flush with the exterior surface of the skirt, thereby retaining cover 90 from longitudinal movement while allowing it to rotate. Additionally, annular flange 96 has an internal rib or bead 105 which interfits within an external groove 106 located within and extending partially around annular recess 104. It will be apparent that even though rotation of cover 90 is allowed, the degree of rotation will be limited by the distance bead 105 can travel in groove 106. Preferably, cover 90 is only permitted to rotate between the closed position, as shown in FIG. 7, and the open position, as illustrated in FIG. 4. Thus, together, bead 105 and groove 106 act as a stop to limit the degree of rotation of cover 90. While not shown, a flexible bead projects outwardly from groove 106 at the end of groove 106 which is located directly below side wall 76. The flexible bead is positioned so that there is a small space just large enough to accommodate bead 105 between it and the end wall of groove 106. It will be apparent that this flexible bead will prevent the accidental opening of the container when it is not in use, since once the cover is rotated to a closed position (FIG. 7) a slight force will be required to propel bead 105 pass the flexible bead.

When cover unit 90 is rotated from an open position (FIG. 4) to a closed position (FIG. 7), cap 91 of cover unit 90 is slidably disposed within continuous groove 80. While groove 80 was previously described as a continuous groove extending around the edges of the first and second cutout sections, it can best be described by referring to the plurality of sections 81, 82, 83, 84 and two sections not shown, which make up the continuous groove. Thus, as best shown in FIGS. 4,6, 9 and 10, section 81 of groove 80 extends downwardly into skirt 58 of closure 54 along the outer edge 70 of the base 74. According to the invention and as best shown in FIG. 9, a portion of arcuate wall member 93 of cap 91 extends downwardly into section 81 of groove 80 and rides in the groove as cover 90 is rotated from a closed position to an open position and vice versa. Like vertical wall member 93 a portion of outer cap portion 92 also rides in a section of groove 80. Thus, as illustrated in FIGS. 6, 8 9 and 10, section 84 of groove 80 extends into top portion 56 of closure 54 along top edge 64 of back wall 78. As illustrated in FIGS. 8 and 9, a portion of outer cap 92, represented by broken line 115 in FIG. 8, extends into this section of the groove and rides in the groove as the cover is rotated.

As best shown in FIG. 4, section 82 of continuous groove 80 extends into skirt 58 of closure 54 along edge 68 of first side wall 76 in a direction substantially parallel to the curved plane formed by skirt 58 of closure 54, while section 83 of groove 80 extends into top portion 56 of closure 54 along the top edge 62 of first side wall 76. Since, as previously described, cap 91 is attached to support member 94 along rib 98, there is a space between the support member and the cap on either side of rib 98. Thus, as best shown in FIG. 8, when the cover is rotated closed, rotation will be permitted until rib 98 abuts first side wall 76. When in this closed position, a portion of arcuate wall member 93 and outer cap portion 92 will extend into sections 82 and 83, respectively, while a corresponding portion of support member 94 overlaps the exterior surfaces of top portion 56 and skirt 58 of closure 54.

While not shown in the drawings, another section of continuous groove 80 extends into top portion 56 of closure 54 along edge 66 of the second side wall (not shown) in a direction parallel to the plane formed by top portion 56. Also not shown is a section of continuous groove 80 which extends into closure 54 along side edge 67 of the second side wall (not shown) in a direction parallel to the curved plane formed by skirt 58. These two sections extend into closure 54 a distance sufficient to accommodate cap 91 when cover 90 is rotated to an open position. Thus, as best shown in FIGS. 4 and 5, when cover 90 is rotated open, a substantial portion of cap 91 is slidably disposed within those two sections of groove 80. The portion of the cap that disappears into the groove is represented by a broken line in FIGS. 4 and 5. Cap 91 will, however, be prevented from completely disappearing into groove 80 by rib 98 which will abut the second side wall, thereby prohibiting any further rotation. It will be apparent that in this closed position a portion of support 94 will overlap the exterior surface of top portion 56 of closure 54.

The operation of the container described in connection with this embodiment is similar to operation of the container previously described. Thus, when it is desired to extract a portion of the contents of the container, cover 90 is rotated so as to reveal spout 100. The container is then slightly tilted and a portion of the contents is forced out by the application of a squeezing force to tubular body 52. The container can thereafter be closed by rotatably positioning cap 91 over spout 100. In this closed position, since each edge of cap 91 will be recessed within a section of continuous groove 80, chamber 72 will be sealingly enclosed. This sealing arrangement will substantially prevent the passage of air, moisture and solids either into or out of the enclosed cavity. Like the embodiment illustrated in FIGS. 1-3*b*, since the outer edge 101 of spout 100 abuts wall member 93 when the cover is in the closed position, material within the container cannot be accidentally discharged into enclosed space 72. Furthermore, since the spout 100 is sealingly enclosed within space 72, it is not exposed to dust, dirt, bacteria and other foreign substances contained in the air. Such an arrangement thus creates a very sanitary dispensing apparatus.

While not absolutely necessary for the purposes of this invention, a directing means may be incorporated into closure 54 to assist in directing the flow of material within container towards spout 100. While any type of directing means may be used, it is presently preferred to use directing discs. Two possible arrangements of the directing discs are illustrated in FIGS. 6 and 10. Thus, as shown in FIG. 6, directing disc 110 is oriented horizontally in closure 54, thereby directing the flow of material within the container towards the spout, while preventing such material from becoming lodged in space 112. In FIG. 10, directing disc 108 is shown oriented at an angle. This directing disc also directs the flow of material within the container towards the spout.

Variations can, of course, be made without departing from the spirit and scope of my invention, as embodied in the above description.

Having thus described my invention, what I desire to secure and claim by Letters Patent is:

1. A dispensing apparatus comprising:

a container including a neck portion enclosing an outflow passage;

a closure for said outflow passage, said closure having a top portion and a skirt extending downwardly from the periphery of said top portion, said closure having a first cutout section in said top portion and a second cutout section in said skirt, said first cutout section and said second cutout section defining a chamber in said closure;

a spout extending outwardly from said chamber to form an opening through which material within said container can be dispensed;

a cover for said spout, said cover being rotatably mounted on said skirt of said closure and comprising a cap member rotatably positionable in alignment with said spout, said cover being in a closed position when said cap member is in alignment with said spout and being in an open position when said cap member is out of alignment with said spout, said cap member defining with said cavity an enclosed space surrounding said spout when said cap member is in alignment with said spout.

2. The dispensing apparatus of claim 1 wherein said closure having a groove circumscribing said chamber comprises a disc shaped top portion, said skirt extending downwardly from the periphery of said top portion, said groove having a first portion of sufficient depth for receiving substantially all of said cap when said cover is in said open position and said first portion of said groove being engageable with a portion of said cap when said cover is in said closed position, said groove having a second portion of substantially less depth than said first portion of said groove and being engageable with the remaining portion of said cap when said cover is in said closed position, for enabling circumferential engagement.

3. The dispensing apparatus of claim 1 wherein said cap member has an outer cap portion and a wall member, a downwardly extending annular flange and a support member for connecting said cap member to said annular flange and wherein said skirt of said closure has an external annular recess, said annular flange being positioned within said annular recess, for retaining said cover member from vertical movement while allowing its revolution.

4. The dispensing apparatus of claim 3 wherein said spout has an outer edge, said outer edge being in an abutting relationship with said wall member of said cap member when said cap member is in said closed position, thereby preventing discharge of said material from said container.

5. The dispensing apparatus of claim 4 wherein said outer edge of said spout is sharp, for facilitating the clean removal of said material from said container.

* * * * *